US007275483B2

(12) United States Patent
Knobel

(10) Patent No.: US 7,275,483 B2
(45) **Date of Patent: *Oct. 2, 2007**

(54) JAM RESISTANT PRINTER BEZEL

(75) Inventor: Larry Knobel, Homer, NY (US)

(73) Assignee: TransAct Technologies Incorporated, Hamden, CT (US)

( * ) Notice: Subject to any disclaimer, the term of this patent is extended or adjusted under 35 U.S.C. 154(b) by 404 days.

This patent is subject to a terminal disclaimer.

(21) Appl. No.: 10/897,731

(22) Filed: Jul. 22, 2004

(65) Prior Publication Data

US 2004/0258450 A1 Dec. 23, 2004

Related U.S. Application Data

(63) Continuation-in-part of application No. 10/394,439, filed on Mar. 20, 2003, now Pat. No. 6,904,843.

(51) Int. Cl.
*B41J 11/00* (2006.01)

(52) U.S. Cl. ..... 101/228; 400/625; 400/642; 400/693; 271/226; 271/293; 902/14; 902/18; 902/30; 235/31 R; 221/151; 221/152

(58) Field of Classification Search ..... 101/228, 101/232; 400/625, 642, 646, 691, 693; 271/293, 271/226; 902/8, 14, 18, 23, 30; 225/13, 225/14, 106; 235/31 R, 31 T; 221/71, 151, 221/152

See application file for complete search history.

(56) References Cited

U.S. PATENT DOCUMENTS

| | | | | |
|---|---|---|---|---|
| 5,215,393 | A | 6/1993 | Wincent | |
| 5,642,922 | A | 7/1997 | Ramachandran et al. | |
| 5,734,404 | A | 3/1998 | Komuro et al. | |
| 6,371,479 | B1 * | 4/2002 | Osaka et al. | 271/186 |
| 6,575,090 | B1 | 6/2003 | Vienneau et al. | |
| 6,602,008 | B2 | 8/2003 | Yamagishi et al. | |
| 6,615,763 | B2 | 9/2003 | Edwards | |
| 6,904,843 | B2 * | 6/2005 | Knobel | 101/228 |

* cited by examiner

*Primary Examiner*—Daniel J. Colilla
*Assistant Examiner*—Kevin D. Williams
(74) *Attorney, Agent, or Firm*—Lipsitz & McAllister, LLC

(57) ABSTRACT

An anti-jam bezel is provided for dispensing a flexible substrate from an output slot. A guideway is provided for receiving the flexible substrate from a transport and guiding the flexible substrate into the output slot. The guideway may extend from the output slot to the transport to provide a substrate receiving opening. The bezel body is adapted for mounting with the substrate receiving opening adjacent the transport such that the guideway catches a leading edge of the substrate after the substrate exits the transport and guides the leading edge into the output slot. In the event the output slot is blocked, the guideway is adapted to guide at least a portion of the substrate into the substrate receiving opening so that at least the portion of the substrate loops into the substrate receiving opening, thereby preventing a jam.

24 Claims, 6 Drawing Sheets

JAM RESISTANT PRINTER BEZEL

This application is a continuation-in-part of commonly owned U.S. patent application Ser. No. 10/394,439 filed Mar. 20, 2003 now U.S. Pat. No. 6,904,843.

FIELD OF THE INVENTION

The present invention relates to a jam resistant bezel from which paper slips such as tickets, vouchers, coupons and the like are dispensed from a vending machine or similar apparatus. The invention is also particularly useful, e.g., in connection with printers for gaming and lottery terminals that provide racetrack tickets, lottery tickets, cashless betting slips and the like to consumers.

BACKGROUND OF THE INVENTION

High speed printers, such as inkjet, thermal, dye sublimation and dot matrix printers are used to provide vouchers, coupons, tickets, receipts and the like (hereinafter generically referred to as "slips") to consumers. Such slips are usually made of paper, onto which text and/or graphics are printed, but may alternatively be made of other flexible materials such as cardstock, plastic (e.g., cellophane or Mylar), laminates, metal foil, etc., as long as the material can be fed through the printer transport mechanism. Typically, the slips are discharged to the consumer after printing via a bezel mounted in the front panel of a self-service terminal. Such terminals can be found, for example, in casinos (e.g., slot machines), retail establishments (e.g., lottery machines), transportation centers (e.g., train, bus and subway ticket machines), gasoline service stations (pump receipts), and the like.

One problem that sometimes arises when dispensing slips to consumers is that the bezel becomes blocked. This can occur either accidentally (e.g., by an impatient consumer placing a finger over the bezel output opening while waiting for the slip to be dispensed), or intentionally (e.g., by a person who becomes frustrated with the results of a wager). Once the bezel is blocked, the slip being discharged from the printer has nowhere to go, resulting in a jam in the printer transport mechanism.

It would be advantageous to provide a bezel design that is resistant to jams when the bezel output opening is blocked. Such a design should provide reliable operation and enable easy recovery of the slip once the blockage is removed.

The present invention provides bezel designs having the aforementioned and other advantages.

SUMMARY OF THE INVENTION

In accordance with the present invention, an anti-jam bezel is provided for dispensing a flexible substrate. The bezel comprises a bezel body having an output slot for outputting a flexible substrate. A guideway is provided for receiving the flexible substrate from a transport and guiding the flexible substrate into the output slot. The guideway may extend from the output slot to the transport to provide a substrate receiving opening. The bezel body is adapted for mounting with the substrate receiving opening adjacent the transport such that the guideway catches a leading edge of the substrate after the substrate exits the transport and guides the leading edge into the output slot. In the event the output slot is blocked, the guideway is adapted to guide at least a portion of the substrate into the substrate receiving opening so that at least the portion of the substrate loops into the substrate receiving opening, thereby preventing a jam.

In one example embodiment, the guideway comprises at least one projection extending from upper and lower edges of the output slot. In particular, the guideway may comprise at least one upper projection extending from an upper edge of the output slot and at least one lower projection extending from a lower edge of the output slot. At least a portion of the lower projection may diverge away from the upper projection to provide the substrate receiving opening which is larger than the output slot. For example, the guideway may comprise a series of upper fingers extending from an upper edge of the output slot and a series of lower fingers extending from a lower edge of the output slot. The upper fingers may extend from the upper edge to the transport. At least a portion of the lower fingers may diverge away from the upper fingers to provide the substrate receiving opening which is larger than the output slot.

At least one opening may be provided at a bottom portion of the substrate receiving opening to permit drainage of liquid introduced into the output slot. For example, a drain hole may be provided in a bottom portion of the bezel body to prevent liquid entering the output slot from entering the transport.

The bezel body may be adapted for mounting on the inside of a terminal housing that contains the transport. Alternatively, the bezel body may be adapted for mounting on the outside of a terminal housing that contains the transport or on a door of a terminal that contains the transport. The flexible substrate may comprise, for example, one of a ticket, a receipt, a document, a check, a coupon, or the like.

A method is provided for preventing jams when dispensing a flexible substrate from an output slot. In accordance with the method, a bezel body having an output slot for dispensing the flexible substrate is provided. A guideway for receiving the flexible substrate from a transport is also provided, the guideway extending from the output slot to the transport to provide a substrate receiving opening. A leading edge of the substrate is caught in the guideway after the substrate exits the transport. The leading edge of the substrate is guided into the output slot via the guideway. At least a portion of the substrate is guided into the substrate receiving opening so that at least this portion of the substrate loops into the substrate receiving opening in the event the output slot is blocked.

BRIEF DESCRIPTION OF THE DRAWINGS

The present invention will hereinafter be described in conjunction with the appended drawing figures, wherein like reference numerals denote like elements, and.

DETAILED DESCRIPTION

The ensuing detailed description provides exemplary embodiments only, and is not intended to limit the scope, applicability, or configuration of the invention. Rather, the ensuing detailed description of the exemplary embodiments will provide those skilled in the art with an enabling description for implementing an embodiment of the invention. It should be understood that various changes may be made in the function and arrangement of elements without departing from the spirit and scope of the invention as set forth in the appended claims.

Turning now to the drawings, there is illustrated a printer, generally referenced 10 and bezels generally referenced 20, 70, and 100 which embody the teachings of the present invention. It is noted that the illustrated structures are only example embodiments that can incorporate the features of the present invention, and other embodiments are possible within the scope of the invention.

Figure 1:
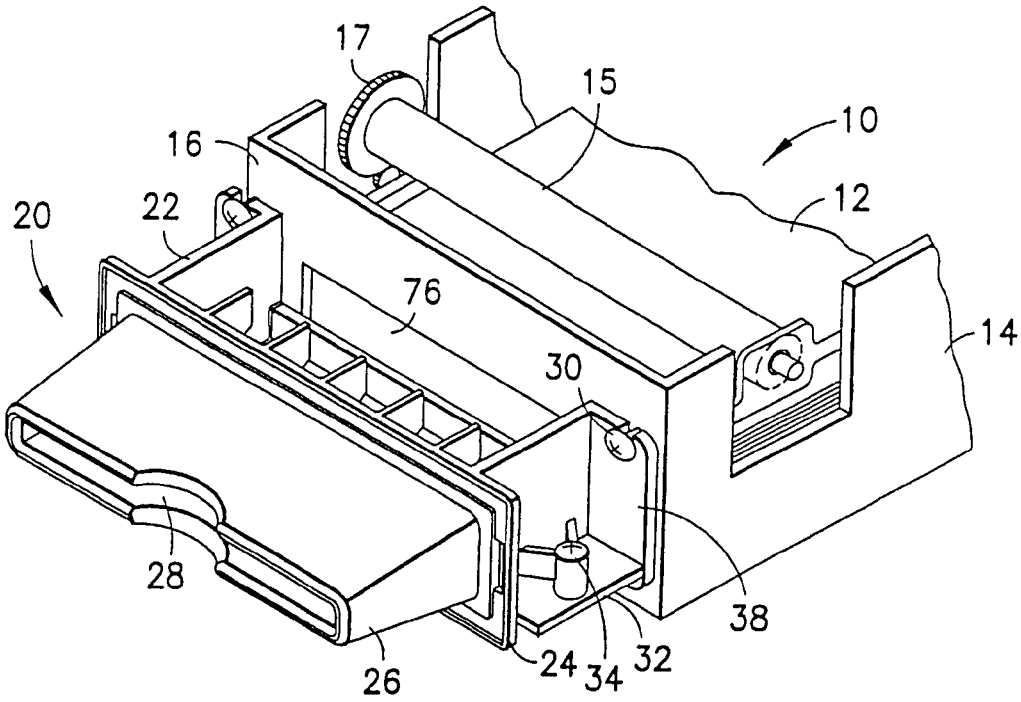
FIG. 1 is a perspective view of a first example embodiment of the invention, in which an internal bezel is shown mounted to a printer.

Referring to FIG. 1, a printer generally designated 10 includes a tray 14 that holds a stack of paper or other substrate to be printed. An example of such a printer is the Series 800, Model 850 thermal printer manufactured by TransAct Technologies Incorporated of Ithaca, N.Y., U.S.A., the assignee of the present application. The printer 10 includes a paper transport mechanism and a print mechanism (not shown) for printing and dispensing flexible substrates such as vouchers, coupons, tickets, receipts and the like ("slips") to consumers. One use of such printers is in gaming and lottery terminals to print and dispense slips such as paper tickets or vouchers having a cash value.

A terminal that includes such a printer will generally output the slip via a bezel. If the output slot of prior art style bezels is blocked, the printer transport will jam. In accordance with the present invention, new types of bezels are provided that are resistant to jams. One example of a jam resistant bezel in accordance with the invention is generally designated 20 in FIG. 1. In the example embodiment of FIG. 1, bezel 20 comprises a bezel body that mounts directly to the front face 16 of printer 10 via rear flanges 38 and appropriate fasteners (e.g., bolts and nuts 30, 36). Pins 46 (FIG. 2) mate with corresponding holes in the front face 16 of the printer to ensure that the bezel is properly located on the printer. Side walls 22 of the bezel body extend between the rear flanges 38 and a front flange 24. A circuit board 32 is mounted under the side walls 22 via bolts 34. The circuit board can, for example, control various lights on the display panel of the terminal.

Figure 3A:
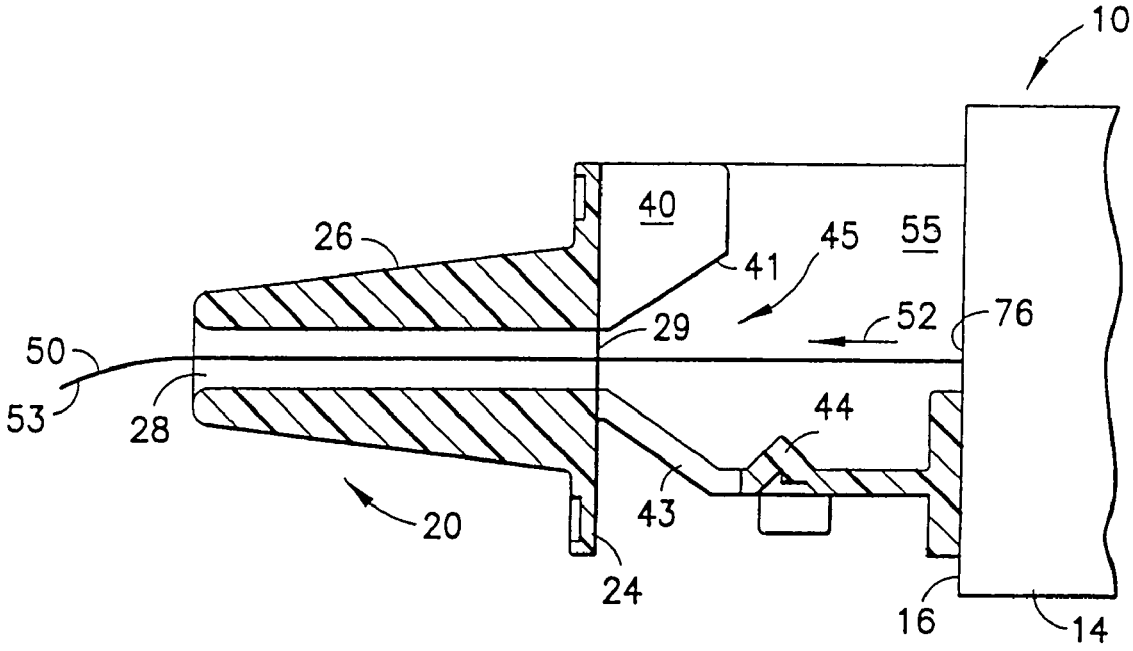
FIG. 3*a* is a cross sectional view of the bezel and printer assembly of FIG. 1 showing the dispensing of a substrate.

Bezel 20 includes an output slot 26 having a front portion 28 for outputting a slip and a rear portion 29 (FIG. 3*a*) for receiving the slip from a transport, such as the paper transport of printer 10. FIG. 1 shows roller 15, which is part of the paper transport of printer 10. Roller 15 is driven by a motor (not shown) via gear 17 to move the paper slip 12 through a print mechanism and out of the printer. As such paper transports are well known in the art, further details thereof are not shown the present drawings.

Figure 2:
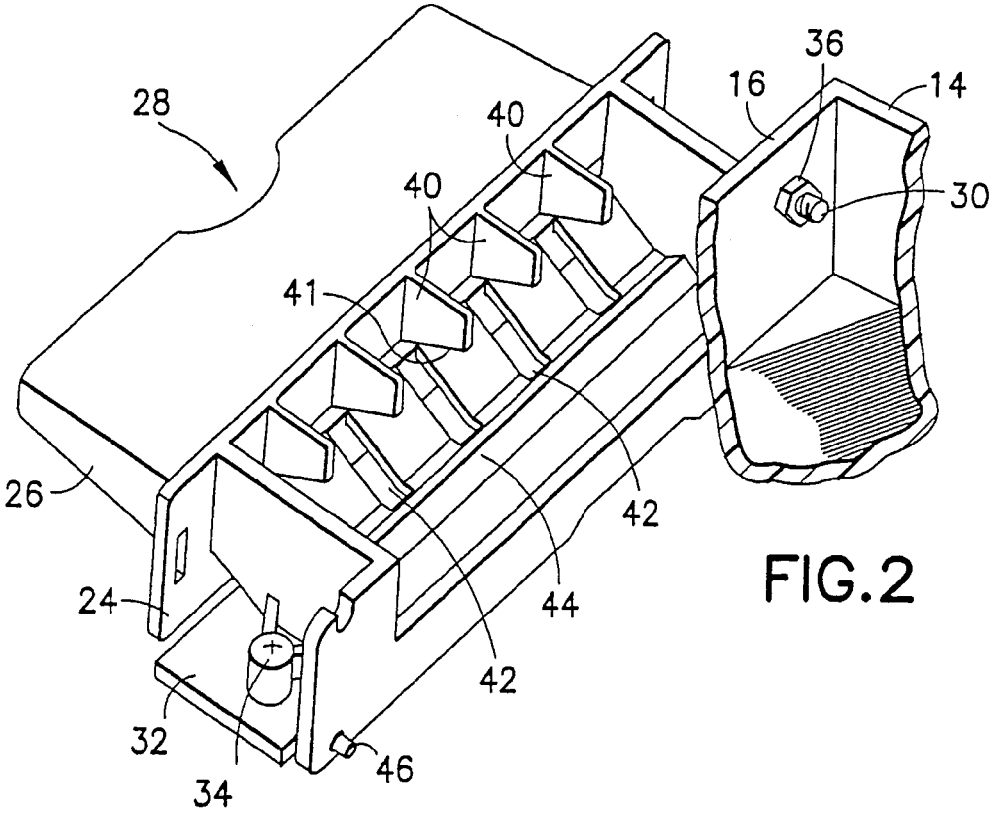
FIG. 2 is a top, rear and right side perspective view of the bezel shown in FIG. 1.

Bezel 20 has a guideway formed from ribs 40, which are tapered on the bottom edges 41 thereof to diverge away from the rear portion 29 of the output slot. In the embodiment of FIGS. 1 to 3, the bezel 20 also has a diverging bottom wall 43, which together with the ribs 40 forms a generally V-shaped opening 45 for receiving a substrate (e.g., a slip) from a printer. Since the V-shaped opening 45 is widest where it is closest to the printer 10, it will catch a leading edge 53 of the substrate 50, as the substrate leaves the exit slot 76 of the printer transport in the direction indicated by arrow 52. After catching the leading edge 53, the V-shaped opening will guide the leading edge to the bezel output slot 26 for output from the front portion 28 thereof.

Figure 3B:
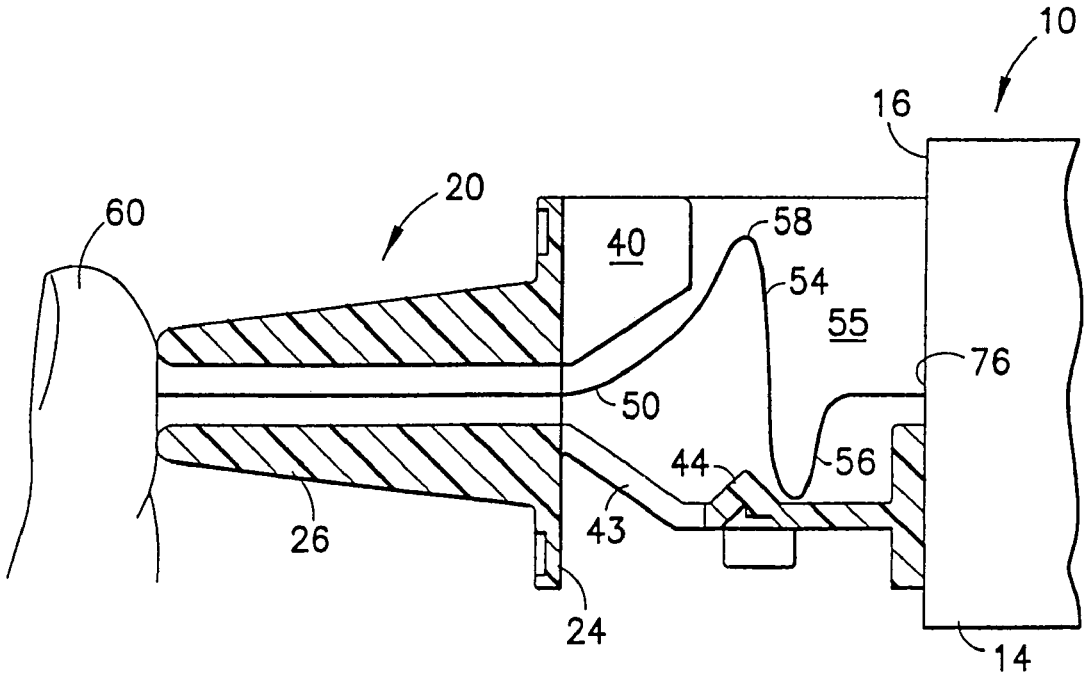
FIG. 3*b* is a cross sectional view of the bezel and printer assembly of FIG. 1 showing a blocked output opening.

The bezel 20 is designed such that it has a cavity 55 situated between the paper transport (printer 10) and the rear portion 29 of the output slot 26. In the event that the front portion 28 of the output slot 26 is blocked, e.g., by a person's finger as shown in FIG. 3*b* when a substrate 50 is trying to exit from the bezel, the V-shaped opening will guide the blocked substrate 50 into the cavity 55 to prevent a paper jam from occurring in the paper transport. In particular, if the leading edge 53 of the substrate is blocked as it tries to exit from the bezel, the ribs 40 or the bottom wall 43 (depending on which way the substrate curls) will assist the substrate 50 in forming a loop 58, 54, 56 within the cavity. A director strip 44, which may be triangular in shape, can also be provided to facilitate the looping of the substrate. In the event that the loop commences along the ribs 40 as shown in FIG. 3*b*, the slope of the director strip 44 closest to the printer will assist in the formation of the loop portion 56. Conversely, if the loop commences along the bottom wall 43, the slope of the director slip 44 closest to the output slot 26 will urge the substrate to loop toward the top of the cavity 55 in the direction of the printer. By providing space for the loop to form, the cavity allows the substrate to be entirely ejected from the transport without causing a jam in the printer.

Another feature of the bezel 20 of FIGS. 1-3 is that it includes openings 42 within the bottom wall 43. These openings are provided for the drainage of liquid. In the event that a disgruntled customer pours coffee or another beverage, for example, into the output slot 26, the openings will drain the liquid prior to reaching the printer. Thus, the printer will be protected from damage that could otherwise result if liquid were to enter the printer exit slot 76.

The bezel body that forms the bezel 20 can be fabricated of any suitable material, such as plastic. The angle at which the guideway formed from ribs 40 and bottom wall 43 diverges from the rear portion 29 of output slot 26 is preferably in a range of about 45° to about 75°, although angles outside this range may also be appropriate. In the specific embodiment shown in the drawings, the angle between the bottom edges 41 and the bottom wall 43 is about 60°.

Figure 4:
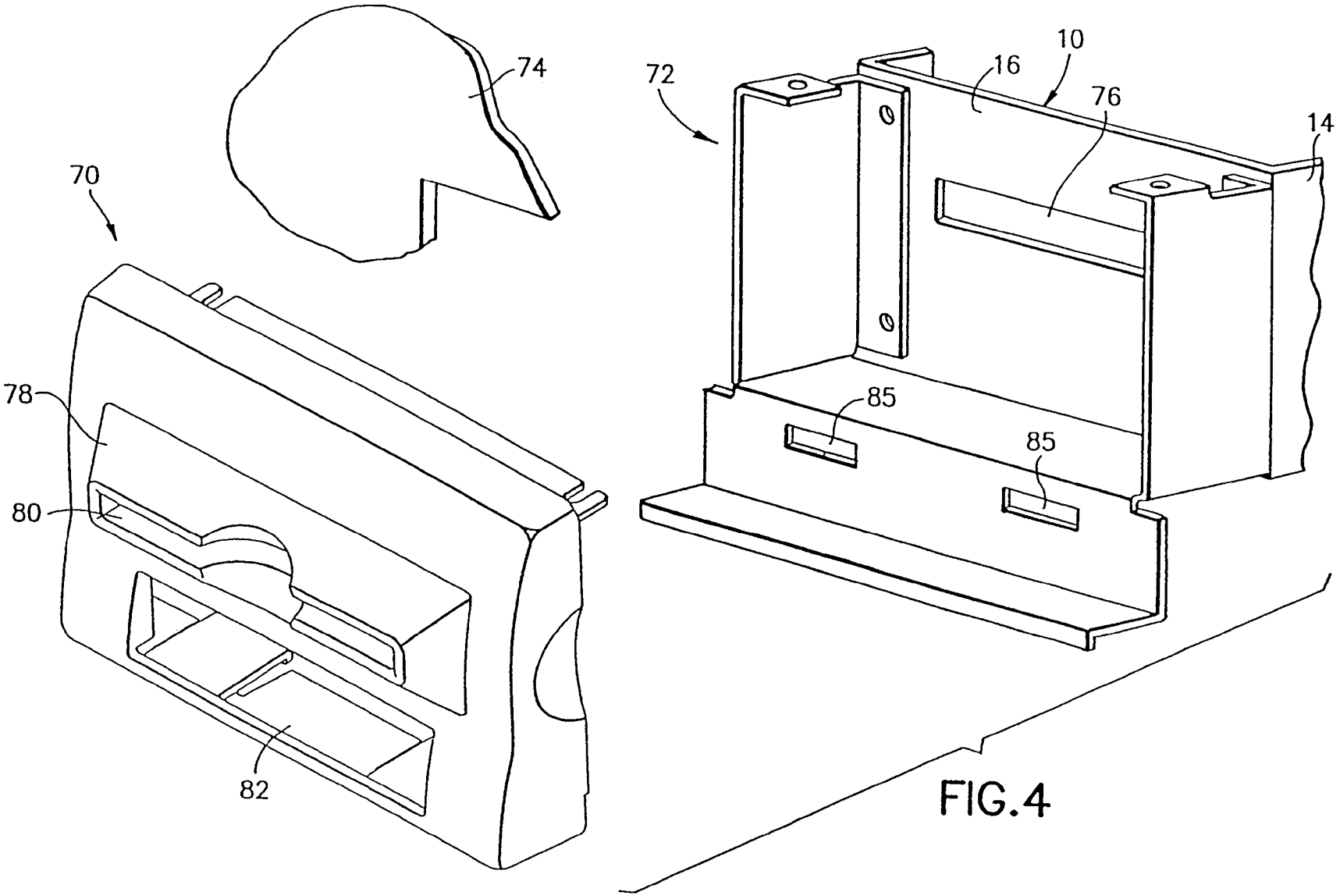
FIG. 4 is an exploded perspective view of a second example embodiment of the invention, in which an external bezel can be mounted over a front panel to a printer via a mounting bracket.
Figure 5:
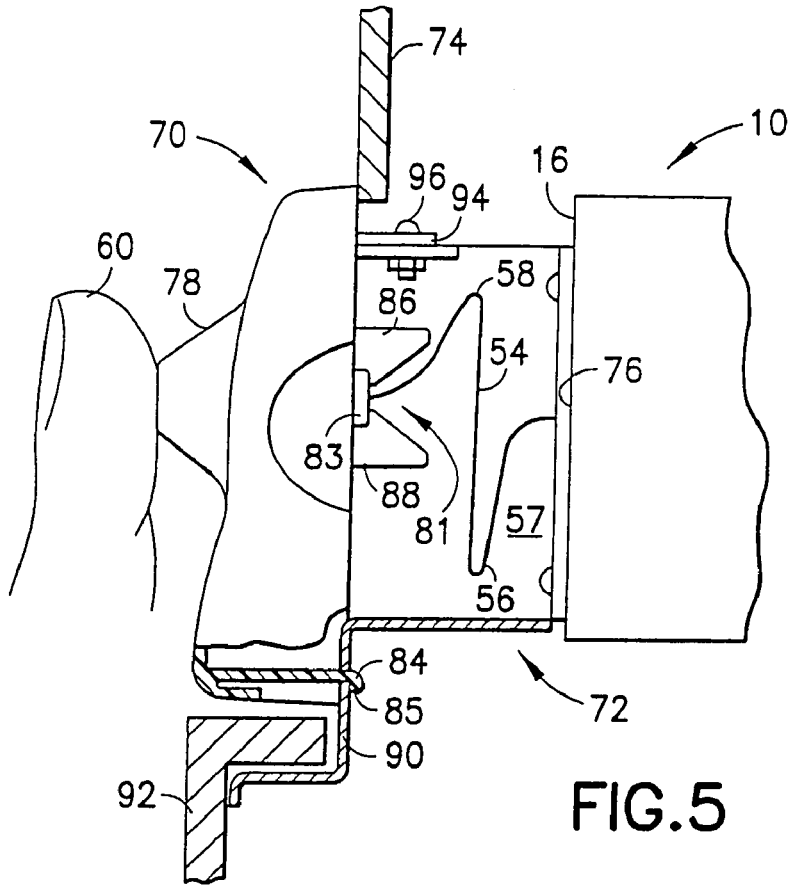
FIG. 5 is a cross sectional view of the bezel of FIG. 4 when mounted via the bracket to the printer, showing a blocked output opening.
Figure 6:
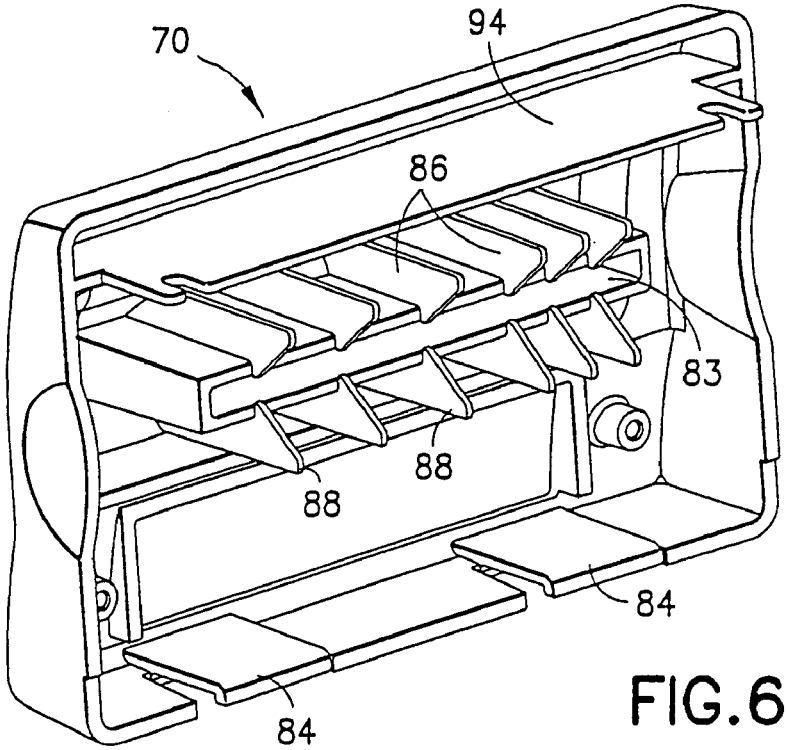
FIG. 6 is a top, rear and right side perspective view of the bezel shown in FIG. 4.

FIGS. 4-6 illustrate another example embodiment, in which a bezel generally designated 70 is mounted external to the front panel 74 of a wagering terminal or the like. The bezel 70 includes an output slot 78 with a front opening 80 through which a slip is dispensed. An opening 82 is provided for mounting a lens that is backlit to illuminate a "retrieve ticket" indicia or the like.

The bezel 70 mounts to a mounting bracket generally designated 72 which, in turn, mounts to the front face 16 of printer 10. As can be seen in FIG. 5, the bezel can be mounted to the bracket 72 via bezel mounting wall 94 using any suitable fastener, such as a bolt 96. Resilient clips 84 can also be provided on the bezel to hook over corresponding slots 85 in the bracket. The front of the bracket can include a portion 90 that provides a channel for accepting the top edge of a door 92 used to gain access to the inside of the terminal. The bracket dimensions provide a cavity 57 between the printer 10 and the bezel 70. In the illustrated embodiment, the bezel is fabricated from plastic and the bracket is metal. It should be appreciated, however, that other satisfactory materials can be substituted.

The back of bezel 70 has top fingers 86 and bottom fingers 88 extending therefrom toward a transport included in printer 10. The fingers form a V-shaped guideway 81 to catch the leading edge of a slip exiting the printer exit opening 76. The guideway also serves to guide the slip into the rear portion 83 of the bezel output slot 78 for dispensing from the front portion 80 of the slot.

In the event the bezel output slot is blocked, for example by a customer's finger 60, the cavity 57 provides a space for the slip to form into a loop 56, 54, 58. The angled portions of fingers 86 and 88, which extend behind the rear portion 83 of the bezel output slot and form the aforementioned V-shaped guideway, assist in the formation of the loop by urging the blocked slip in an upward or downward direction as the transport continues to push the slip in the direction of the output slot. By allowing the loop to form, the slip can exit the printer 10 via slot 76 without jamming in the printer transport.

As with the embodiment of FIGS. 1-3, the angle formed between fingers 86 and 88 (which results in the V-shaped opening) can be on the order of about 45° to about 75°, although angles outside this range may also be appropriate. In the specific embodiment shown in the drawings, the angle between the sloped fingers is about 60°.

Figure 7:
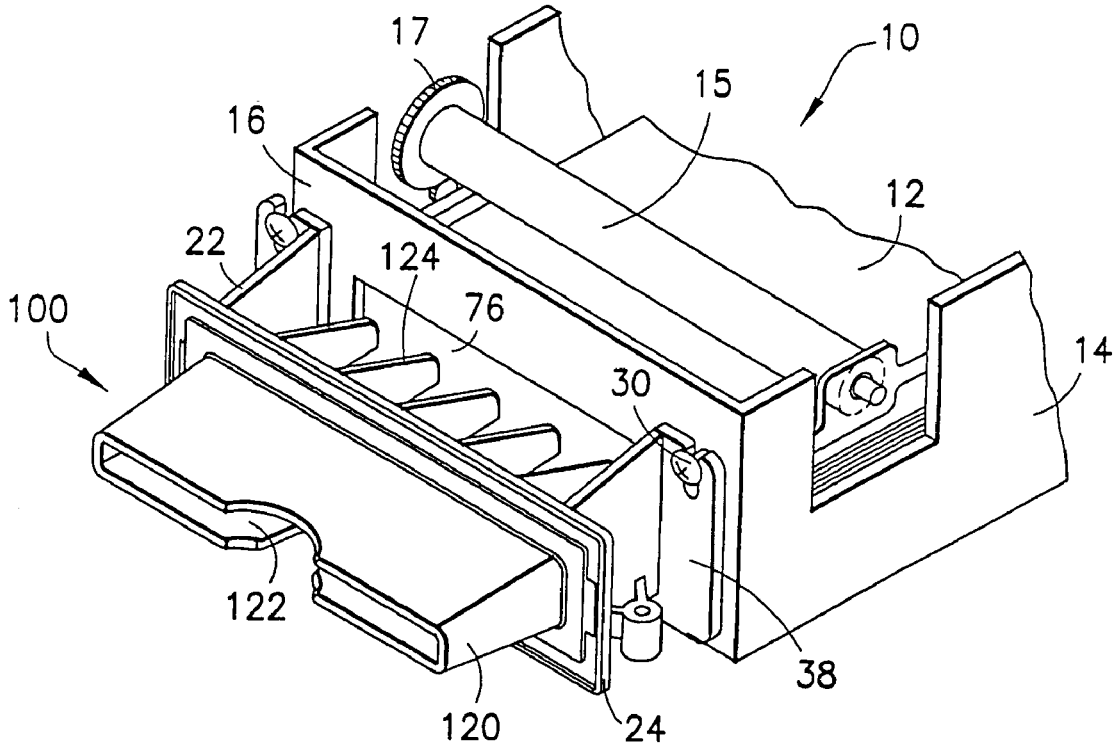
FIG. 7 is a perspective view of a third example embodiment of the invention, in which an internal bezel is shown mounted to a printer.
Figure 8:
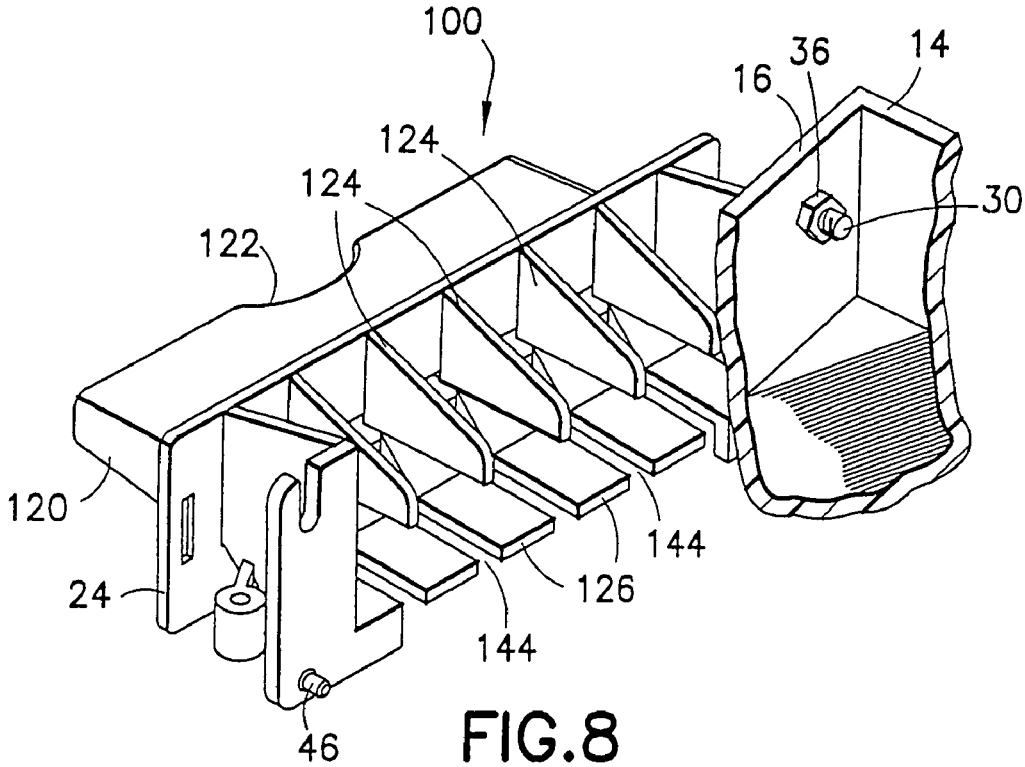
FIG. 8 is a top, rear and right side perspective view of the bezel shown in FIG. 7.
Figure 9A:
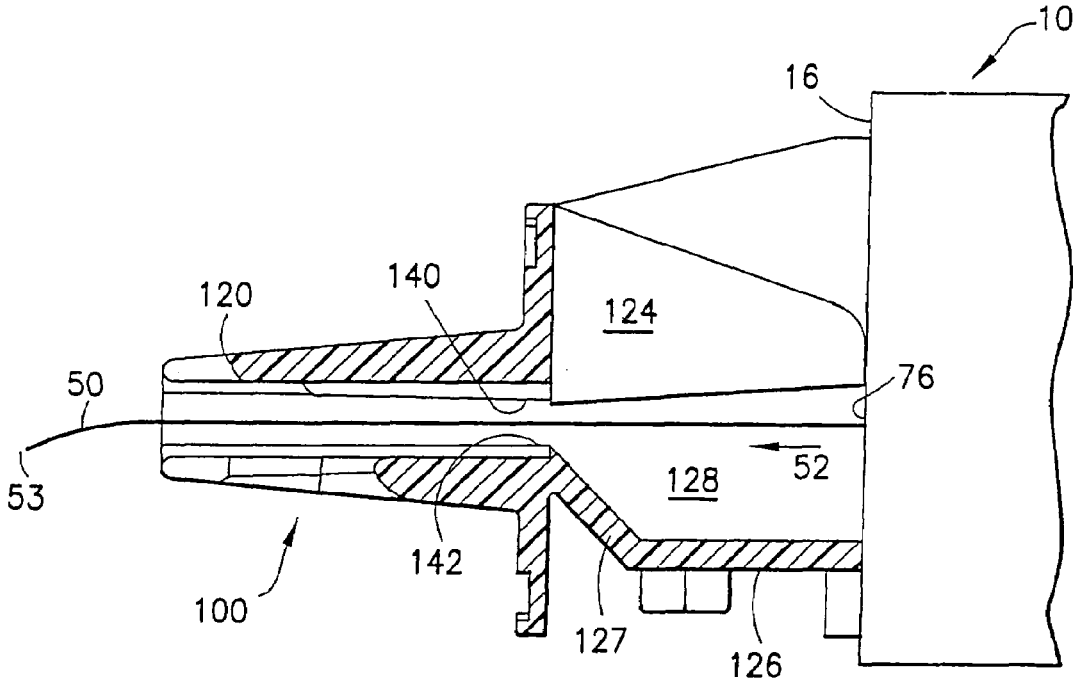
FIG. 9*a* is a cross sectional view of the bezel and printer assembly of FIG. 7 showing the dispensing of a substrate.

FIGS. 7-9 illustrate a further example embodiment of a bezel in accordance with the present invention. The bezel 100 comprises a bezel body that has an output slot 120 for outputting a flexible substrate 50 from a front portion 122 thereof. A guideway is provided for receiving the flexible substrate 50 from an exit slot 76 of a transport of the printer 10 and guiding the flexible substrate 50 into the output slot 120. The guideway may be formed from at least one projection 124 which extends from the output slot 120 to the transport (e.g., the front face 16 of the printer 10). In the embodiment shown in FIGS. 7-9, the guideway is also formed by a bottom wall 126, which may be comprised of at least one projection. Together, the projections 124 and the bottom wall 126 provide a substrate receiving opening 128.

The bezel body is adapted for mounting with the substrate receiving opening 128 adjacent the transport (e.g., the front face 16 of the printer 10) as discussed above in connection with bezel 20 shown in FIGS. 1-3. When mounted to the transport or front face 16 of the printer 10, the guideway catches a leading edge 53 of the substrate 50 after the substrate exits the transport (e.g., from exit slot 76) as indicated by arrow 52. The guideway guides the leading edge 53 into the output slot 120 for output from the front portion 122 thereof.

Figure 9B:
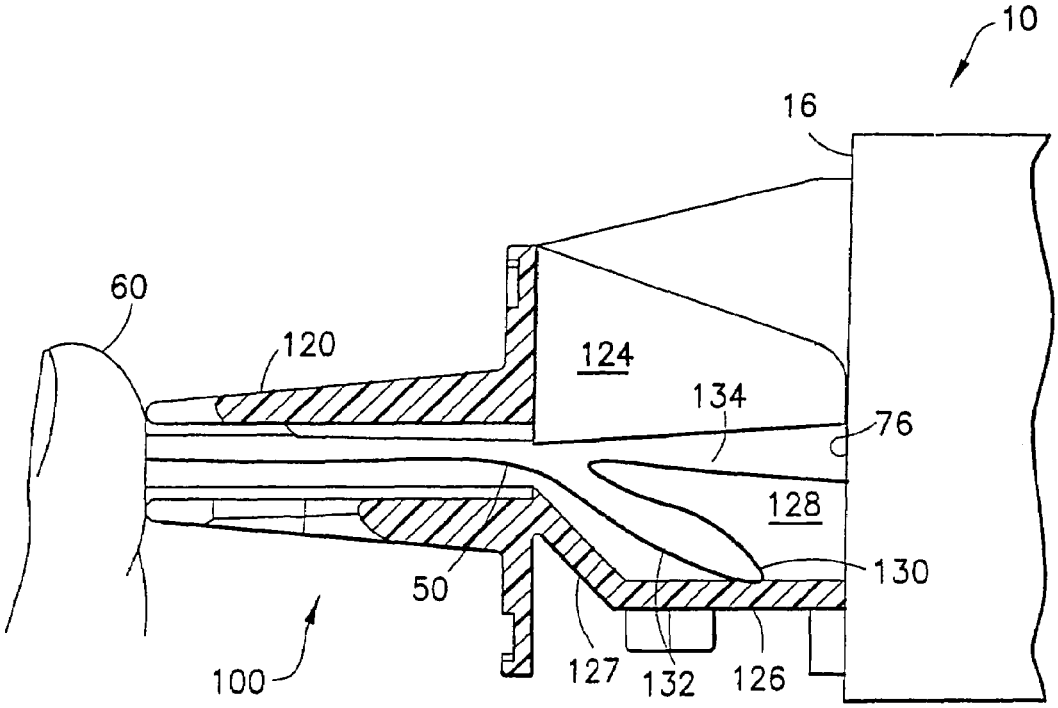
FIG. 9*b* is a cross sectional view of the bezel and printer assembly of FIG. 7 showing a blocked output opening.

The bezel 100 is designed in such a manner that the substrate receiving opening 128 is situated between the transport (in this case the front face 16 of printer 10) and the output slot 120. The substrate receiving opening 128 is wider than the output slot. Therefore, in the event that the output slot 120 is blocked (for example by a person's finger 60 as shown in FIG. 9*b*) when the substrate 50 is being output from the front portion 122 of the output slot 120, the guideway is adapted to guide at least a portion of the substrate 50 into the substrate receiving opening 128 so that at least a portion of the substrate 50 loops into the substrate receiving opening, thereby preventing a jam. In particular, if the leading edge 53 of the substrate is blocked as it tries to exit from the bezel, the projections 124 or the bottom wall 126 (depending on which way the substrate curls) will assist the substrate 50 in forming a loop 130 within the substrate receiving opening 128. By providing space for the loop to form, the substrate receiving opening 128 allows the substrate to be entirely ejected from the transport without causing a jam in the printer 10.

In FIG. 9*b*, the loop 130 is shown being formed by the substrate folding over on top of itself. In this case, a leading portion 132 of the substrate 50 first curls downward and against bottom wall 126 as it is fed into the output slot 120 and an end portion 134 of the substrate loops over the top of the leading portion 132 as it continues to be fed into the substrate receiving opening 128. It should be appreciated that the substrate 50 may also loop the opposite way (not shown). For example, the leading portion 132 of the substrate 50 may first curl upward and against the projection 124 so that the end portion 134 folds under the leading portion 132 resulting in a loop that is the opposite of loop 130 shown in FIG. 9*b*.

Those skilled in art will notice that the loops obtained in the substrate receiving opening 128 of the bezel 100 shown in FIG. 9*b* may be seen as horizontally oriented loops. In contrast, the loop 54, 56, 58 shown in the FIG. 3*b* embodiment and the FIG. 5 embodiment may be seen as a vertically oriented loops. The difference in the formation of the loop in the bezel 100 and that of bezels 20 and 70 is due to the fact that the projections which form the guideway of the bezel 100 extend from the output slot to the outer wall of the transport (i.e., the front face 16 of the printer 10). This prevents the substrate from looping vertically as shown in the FIG. 3*b* and FIG. 5 embodiments. In contrast, the fingers 86 and 88 of the FIG. 5 embodiment do not extend to the front face 16 and thus do not prohibit the substrate from looping vertically. Similarly, the ribs 40 and bottom wall 43 of the FIG. 3*b* embodiment do not extend to the front face 16, which allows the substrate to loop vertically.

The guideway of bezel 100 may comprise at least one projection 124, 126 extending from respective upper and lower edges 140, 142 of the output slot. In particular, the guideway may comprise an upper projection 124 extending from an upper edge 140 of the output slot and a lower projection 126 extending from a lower edge 142 of the output slot. At least a portion 127 of the lower projection 126 may diverge away from the upper projection 124 to provide the substrate receiving opening 128 which is larger than the output slot 120. For example, the guideway may comprise a series of upper fingers 124 extending from an upper edge 140 of the output slot 120 and a series of lower fingers 126 extending from a lower edge 142 of the output slot 120. The upper fingers 124 may extend from the upper edge 140 to the transport. At least a portion 127 of the lower fingers 126 may diverge away from the upper fingers 124 to provide the substrate receiving opening 128 which is larger than the output slot 120.

At least one opening 144 may be provided at a bottom portion of the substrate receiving opening 128 to permit drainage of liquid introduced into the output slot 120. For example, a drain hole may be provided in a bottom portion of the bezel body 100 to prevent liquid entering the output slot 120 from entering the transport or printer 10.

Although FIGS. 7-9 show the bezel 100 mounted on the outside of a housing that contains the transport, it should be apparent to those skilled in the art that the bezel 100 may be easily adapted for mounting on a door of a terminal that contains the transport or on the inside of a terminal housing that contains the transport.

Those skilled in the art will appreciate that various features of any one of the described example embodiments may be used in conjunction with various features of other of the described example embodiments.

It should now be appreciated that the present invention provides bezel structures that enable a slip to exit a printer without jamming, even if the bezel output slot is blocked. A guideway is provided at the back of the bezel for catching the leading edge of a slip to be dispensed, and guiding the slip to an output slot. The guideway is constructed such that it cooperates with a cavity between the output slot and the printer, to enable a slip to loop within the cavity upon blockage of the output slot. Since the cavity provides a place for the slip to go, the slip can exit the printer without jamming.

While the present invention has been particularly shown and described with reference to various preferred modes as illustrated in the drawings, it will be understood by those skilled in the art that various changes in detail may be effected therein without departing from the spirit and scope of the invention as defined by the claims.

What is claimed is:

1. An anti-jam bezel for dispensing a flexible substrate, comprising:

a bezel body;

an output slot in said bezel body for outputting said flexible substrate;

a guideway for receiving said flexible substrate from a transport and guiding said flexible substrate into said output slot, said guideway extending from said output slot to said transport to provide a substrate receiving opening;

wherein:

said bezel body is adapted for mounting with said substrate receiving opening adjacent said transport such that said guideway catches a leading edge of said substrate after the substrate exits the transport and guides said leading edge into said output slot; and in the event said output slot is blocked, said guideway is adapted to guide at least a portion of said substrate into said substrate receiving opening so that at least said portion of said substrate loops into said substrate receiving opening.

2. A bezel in accordance with claim 1, wherein:

said guideway comprises at least one projection extending from respective upper and lower edges of said output slot.

3. A bezel in accordance with claim 1, wherein said guideway comprises:

at least one upper projection extending from an upper edge of said output slot; and at least one lower projection extending from a lower edge of said output slot.

4. A bezel in accordance with claim 3, wherein:

at least a portion of said lower projection diverges away from said upper projection to provide said substrate receiving opening which is larger than said output slot.

5. A bezel in accordance with claim 1, wherein:

said guideway comprises a series of upper fingers extending from an upper edge of the output slot and a series of lower fingers extending from a lower edge of the output slot.

6. A bezel in accordance with claim 5 wherein:

said upper fingers extend from the upper edge to the transport; and at least a portion of said lower fingers diverge away from the upper fingers to provide said substrate receiving opening which is larger than said output slot.

7. A bezel in accordance with claim 1, wherein:

at least one opening is provided at a bottom portion of said substrate receiving opening to permit drainage of liquid introduced into said output slot.

8. A bezel in accordance with claim 1, further comprising:

at least one drain hole in said bezel body to prevent liquid entering said output slot from entering said transport.

9. A bezel in accordance with claim 1, wherein:

said bezel body is adapted for mounting on the inside of a terminal housing that contains said transport.

10. A bezel in accordance with claim 1, wherein:

said bezel body is adapted for mounting on the outside of a terminal housing that contains said transport.

11. A bezel in accordance with claim 1, wherein:

said bezel body is adapted for mounting on a door of a terminal that contains said transport.

12. A bezel in accordance with claim 1, wherein:

said flexible substrate comprises one of a ticket, a receipt, a document, a check, or a coupon.

13. A method for preventing jams when dispensing a flexible substrate from an output slot, comprising:

providing a bezel body having an output slot for dispensing said flexible substrate and a guideway for receiving said flexible substrate from a transport, said guideway extending from said output slot to said transport to provide a substrate receiving opening;

catching a leading edge of said substrate in said guideway after said substrate exits the transport;

guiding said leading edge into the output slot via said guideway; and guiding at least a portion of said substrate into said substrate receiving opening so that at least said portion of said substrate loops into said substrate receiving opening in the event said output slot is blocked.

14. A method in accordance with claim 13, wherein:

said guideway comprises at least one projection extending from respective upper and lower edges of said output slot.

15. A method in accordance with claim 13, wherein said guideway comprises:

at least one upper projection extending from an upper edge of said output slot; and at least one lower projection extending from a lower edge of said output slot.

16. A method in accordance with claim 15, wherein:

at least a portion of said lower projection diverges away from said upper projection to provide said substrate receiving opening which is larger than said output slot.

17. A method in accordance with claim 13, wherein:

said guideway comprises a series of upper fingers extending from an upper edge of the output slot and a series of lower fingers extending from a lower edge of the output slot.

18. A method in accordance with claim 17 wherein:

said upper fingers extend from the upper edge to the transport; and at least a portion of said lower fingers diverge away from the upper fingers to provide said substrate receiving opening which is larger than said output slot.

19. A method in accordance with claim 13, further comprising:

providing at least one opening at a bottom portion of said substrate receiving opening to permit drainage of liquid introduced into said output slot.

20. A method in accordance with claim 13, further comprising:

providing at least one drain hole in said bezel body to prevent liquid entering said output slot from entering said transport.

21. A method in accordance with claim 13, wherein:

said bezel body is adapted for mounting on the inside of a terminal housing that contains said transport.

22. A method in accordance with claim 13, wherein:

said bezel body is adapted for mounting on the outside of a terminal housing that contains said transport.

23. A method in accordance with claim 13, wherein:

said bezel body is adapted for mounting on a door of a terminal that contains said transport.

24. A method in accordance with claim 13, wherein:

said flexible substrate comprises one of a ticket, a receipt, a document, a check, or a coupon.

* * * * *